US007101587B2

(12) United States Patent
Gingras et al.

(10) Patent No.: US 7,101,587 B2
(45) **Date of Patent: *Sep. 5, 2006**

(54) METHOD FOR WETTING AND WINDING A SUBSTRATE

(75) Inventors: Brian James Gingras, Appleton, WI (US); Daniel Hoo, Appleton, WI (US); Paul Kerner Pauling, Appleton, WI (US); Clayton Taylor Gann, Appleton, WI (US); Robert Eugene Krautkramer, Kaukauna, WI (US); James Monroe Perkins, Appleton, WI (US); Anthony Mark Gambaro, Appleton, WI (US); Robert Alvin Barkhau, Aiken, SC (US); Andrew Peter Doyle, Marinez, GA (US); James Leo Baggot, Menasha, WI (US); Joe Cwiakala, Battlecreek, MI (US); Valter Di Nardo, Segromigno in Monte (IT); Massimiliano Adalberti, S. Maria del Giudice (IT); Stefano Petri, S. Anna (IT); Giulio Betti, Capannori (IT)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 597 days.

This patent is subject to a terminal disclaimer.

(21) Appl. No.: 09/900,746

(22) Filed: Jul. 6, 2001

(65) Prior Publication Data

US 2003/0015209 A1 Jan. 23, 2003

(51) Int. Cl.
*B05D 3/12* (2006.01)

(52) U.S. Cl. ..... 427/177; 427/179; 427/289; 427/290; 427/293

(58) Field of Classification Search ..... 427/177, 427/179, 428, 424, 420, 293, 289, 290
See application file for complete search history.

(56) References Cited

U.S. PATENT DOCUMENTS

| | | | |
|---|---|---|---|
| 257,761 | A | 5/1882 | Ridgway |
| 258,895 | A | 6/1882 | Crawshaw |
| 273,198 | A | 2/1883 | Vaughan |
| 395,645 | A | 1/1889 | Anderson |
| 1,195,888 | A | 8/1916 | Wheelwright |
| 1,235,183 | A | 7/1917 | Butterworth |
| 1,302,352 | A | 4/1919 | French |
| 1,316,782 | A | 9/1919 | Frothingham et al. |
| 1,558,271 | A | 10/1925 | Newell |
| 1,901,080 | A | 3/1933 | Bradner |

(Continued)

FOREIGN PATENT DOCUMENTS

EP 0 014 520 A1 8/1980

(Continued)

OTHER PUBLICATIONS

Hawley's Condensed Chemical Dictionary, 14th Edition, definition of "acrylic resin", 2002.*

(Continued)

*Primary Examiner*—Kirsten Jolley
(74) *Attorney, Agent, or Firm*—Brinks Hofer Gilson & Lione

(57) ABSTRACT

A method of making wet rolls includes providing a web of material, applying a wetting solution to the web to produce a wet web, and winding the wet web into a roll. The wetting solution may be applied at an add-on greater than 25%, and the web may travel at a speed of at least 60 meters per minute.

18 Claims, 10 Drawing Sheets

U.S. PATENT DOCUMENTS

| | | | |
|---|---|---|---|
| 1,956,561 | A | 5/1934 | Coates |
| 2,025,375 | A | 12/1935 | Cameron et al. |
| 2,054,113 | A | 9/1936 | Abrahms et al. |
| 2,059,881 | A | 11/1936 | Lane |
| 2,066,780 | A | 1/1937 | Holt |
| 2,119,480 | A | 5/1938 | Codwise |
| 2,186,957 | A | 1/1940 | Collings et al. |
| 2,251,295 | A | 8/1941 | Sheesley |
| 2,257,113 | A | 9/1941 | George |
| 2,321,938 | A | 6/1943 | Quinn |
| 2,333,629 | A | 11/1943 | Beadle, Sr. |
| 2,361,082 | A | 10/1944 | Brown |
| 2,556,262 | A | 6/1951 | Faeber |
| 2,562,457 | A | 7/1951 | Hannay et al. |
| 3,019,130 | A | 1/1962 | Hornbostel |
| 3,066,046 | A | 11/1962 | Walton |
| 3,097,968 | A | 7/1963 | Schaefer |
| 3,668,905 | A | 6/1972 | Schlunke |
| 3,766,756 | A | 10/1973 | Farrar |
| 3,776,482 | A | 12/1973 | Mras |
| 3,776,763 | A | 12/1973 | Ross |
| 3,797,281 | A | 3/1974 | Norton |
| 3,830,143 | A | 8/1974 | Dowd, Jr. |
| 3,844,813 | A | 10/1974 | Leonard et al. |
| 3,853,279 | A | 12/1974 | Gerstein |
| 3,856,226 | A | 12/1974 | Dowd, Jr. |
| 3,873,025 | A | 3/1975 | Qvarnstrom |
| 3,906,893 | A | 9/1975 | Scales |
| 3,949,035 | A | 4/1976 | Dunning et al. |
| 3,980,043 | A | 9/1976 | Pomper |
| 4,045,598 | A | 8/1977 | Henson |
| 4,108,110 | A | 8/1978 | Berry |
| 4,213,218 | A | 7/1980 | Winch |
| 4,247,362 | A | 1/1981 | Williams |
| 4,257,343 | A | 3/1981 | Kullander |
| 4,259,924 | A | 4/1981 | Smith |
| 4,338,876 | A | 7/1982 | Norton |
| 4,447,924 | A | 5/1984 | Bolton et al. |
| 4,485,980 | A | 12/1984 | Gorner |
| 4,487,377 | A | 12/1984 | Perini |
| 4,533,435 | A | 8/1985 | Intili |
| 4,556,454 | A | 12/1985 | Dahl et al. |
| 4,565,155 | A | 1/1986 | Koski |
| 4,583,698 | A | 4/1986 | Nistri et al. |
| 4,590,099 | A | 5/1986 | Reith |
| 4,601,256 | A | 7/1986 | Poterala |
| 4,601,938 | A | 7/1986 | Deacon et al. |
| 4,649,695 | A | 3/1987 | Crouch et al. |
| 4,695,005 | A | 9/1987 | Gietman, Jr. |
| 4,723,724 | A | 2/1988 | Bradley |
| 4,741,944 | A | 5/1988 | Jackson et al. |
| 4,790,491 | A | 12/1988 | Mundus et al. |
| 4,803,194 | A | 2/1989 | Bracewell |
| 4,807,825 | A | 2/1989 | Eisner et al. |
| 4,856,725 | A | 8/1989 | Bradley |
| 4,865,221 | A | 9/1989 | Jackson |
| 4,929,474 | A | 5/1990 | Avni et al. |
| 4,962,897 | A | 10/1990 | Bradley |
| 5,049,440 | A | 9/1991 | Bornhoeft, III et al. |
| 5,076,424 | A | 12/1991 | Nakamura |
| 5,089,296 | A | 2/1992 | Bafford et al. |
| 5,104,055 | A | 4/1992 | Buxton |
| 5,137,225 | A | 8/1992 | Biagiotti |
| 5,152,121 | A | 10/1992 | Nakamura |
| 5,152,471 | A | 10/1992 | Goerner |
| 5,201,164 | A | 4/1993 | Kaufman |
| 5,243,841 | A | 9/1993 | Fleissner |
| 5,271,575 | A | 12/1993 | Weinert |
| 5,275,348 | A | 1/1994 | Looser |
| 5,304,391 | A | 4/1994 | Rantanen |
| 5,314,119 | A | 5/1994 | Watt |
| 5,389,148 | A | 2/1995 | Matsunaga |
| 5,401,315 | A | 3/1995 | Salo et al. |
| 5,402,960 | A | 4/1995 | Oliver et al. |
| 5,449,328 | A | 9/1995 | Schmidt et al. |
| 5,478,027 | A | 12/1995 | Alexander, III |
| 5,501,775 | A | 3/1996 | Kotitschke et al. |
| 5,509,161 | A | 4/1996 | Neveu et al. |
| 5,527,255 | A | 6/1996 | Mansfield |
| 5,538,199 | A | 7/1996 | Biagiotti |
| 5,540,332 | A | 7/1996 | Kopacz et al. |
| 5,542,622 | A | 8/1996 | Biagiotti |
| 5,545,295 | A | 8/1996 | Fujita et al. |
| 5,578,124 | A | 11/1996 | Cleveland et al. |
| 5,603,467 | A | 2/1997 | Perini et al. |
| 5,639,046 | A | 6/1997 | Biagiotti |
| 5,648,083 | A | 7/1997 | Blieszner et al. |
| 5,660,349 | A | 8/1997 | Miller et al. |
| 5,667,635 | A * | 9/1997 | Win et al. ..... 162/109 |
| 5,690,296 | A | 11/1997 | Biagiotti |
| 5,759,339 | A | 6/1998 | Hartman |
| 5,839,680 | A | 11/1998 | Biagiotti |
| 5,848,756 | A | 12/1998 | Sollinger et al. |
| 5,913,905 | A | 6/1999 | Fleissner |
| 5,958,187 | A | 9/1999 | Bhat et al. |
| 6,056,229 | A | 5/2000 | Blume et al. |
| 6,140,551 | A | 10/2000 | Niemeyer et al. |
| 6,228,216 | B1 | 5/2001 | Lindsay et al. |
| 6,248,211 | B1 | 6/2001 | Jennings et al. |
| 6,444,214 | B1 * | 9/2002 | Cole et al. ..... 424/401 |
| 6,651,924 | B1 * | 11/2003 | Gingras et al. ..... 242/541.2 |

FOREIGN PATENT DOCUMENTS

| | | |
|---|---|---|
| EP | 0 014 520 B1 | 8/1980 |
| EP | 0 026 091 A1 | 4/1981 |
| EP | 0 026 091 B1 | 4/1981 |
| EP | 0 256 950 A1 | 2/1988 |
| EP | 0 580 561 A2 | 1/1994 |
| EP | 0 641 885 A1 | 3/1995 |
| EP | 0 895 956 A1 | 2/1999 |
| JP | 2-91300 | 3/1990 |
| JP | 5-209395 | 8/1993 |
| JP | 6-306793 | 11/1994 |
| JP | 10174670 | 6/1998 |
| WO | WO 98/03713 | 1/1998 |
| WO | WO 99/29958 | 6/1999 |
| WO | WO 99/33623 | 7/1999 |
| WO | WO 01/40090 A2 | 6/2001 |
| WO | WO 01/82986 A2 | 11/2001 |

OTHER PUBLICATIONS

SINCRO Brochure, Fabio Perini, S.p.A., 9 pages, no date.

Copy of International Search Report from corresponding PCT application No. PCT/US01/20216, dated Oct. 7, 2002, 3 pages.

Copy of Partial International Search Report from corresponding PCT application No. PCT/US01/21030, dated Oct. 28, 2002, 3 pages.

Search Report for Patent Cooperation Treaty application No. PCT/US02/21030, Date of Mailing Feb. 21, 2003, 6 pages.

* cited by examiner

METHOD FOR WETTING AND WINDING A SUBSTRATE

BACKGROUND OF THE INVENTION

Wet products such as wet wipes have many applications. They may be used with small children and infants when changing diapers, they may be used for house hold cleaning tasks, they may be used for cleaning hands, they may be used as a bath tissue, they may be used as by a caregiver to clean a disabled or incontinent adult, or they may be used in and for a whole host of other applications, where it is advantageous to have a wipe or towel that has some moisture in it.

Wet wipes have traditionally been made in processes in which larger webs of wipes are initially made and than these larger webs are converted into smaller rolls or sheets that can be placed in a dispenser. Embodiments of dispensers are described in U.S. Pat. Nos. 6,705,565 and 6,626,395; U.S. Pat. Nos. 6,702,227; 6,537,631; 6,682,013; and 6,659,391, filed Sep. 12, 2000; patent application Ser. No. 09/659,307; 09/660,049; 09,659,311 (abandoned); and Ser. No. 09/659,306, filed Sep. 12, 2000; in application Ser. No. 09/748,618 (abandoned), filed Dec. 22, 2000; in application Ser. No. 09/841,323, filed Apr. 24, 2001; in application Ser. No. 09/844,731, filed Apr. 27, 2001; and in application Ser. No. 09/849,935, filed May 4, 2001, commonly owned, all the disclosures of which are incorporated herein by reference.

Wet wipes can be any wipe, towel, tissue or sheet like product including natural fibers, synthetic fibers, synthetic material and combinations thereof, that is wet or moist. Examples of wet wipes are disclosed in U.S. Pat. Nos. 6,683,143; 6,429,261; 6,599,848; 6,444,214; 6,713,414; 6,548,592; 6,579,570; 6,653,406; and 6,537,663; and application Ser. Nos. 09/565,125 and 09/564,531, commonly owned, all filed May 4, 2000, and U.S. Pat. No. 6,423,804, entitled Ion-Sensitive Hard Water Dispersible Polymers And Applications Therefor, filed Dec. 31, 1998, the disclosures of which are incorporated herein by reference.

There is a need for improved methods for making wet wipes, particularly for making rolls of wet wipes. Typically, wet wipes are manufactured as a roll of dry sheets and are then soaked in a wetting solution. Among other disadvantages, this method can lead to undesirable variations in the properties and performance of the wipes. It is desirable to manufacture wet wipes such that the wetting solution and its ingredients are uniformly distributed throughout the roll. It is also desirable to manufacture coreless rolls of wet wipes, which can be more conveniently packaged and sold.

BRIEF SUMMARY OF THE INVENTION

In an embodiment of the invention there is provided a method of making wet rolls, comprising providing a web of material; applying a wetting solution to the web to produce a wet web; and winding the wet web into a roll.

These embodiments may further comprise a method wherein the wetting solution is applied at an add-on greater than about 25%; the wetting solution is applied at an add-on between about 25% and about 700%; the wetting solution is applied at an add-on between about 50% and 400%; the wetting solution is applied at an add-on between about 100% and 350%; the wetting solution is applied at an add-on between about 150% and 300%; and the wetting solution is applied at an add-on between about 200% and 250%. These embodiments may yet further comprise a method wherein the web travels at a speed of at least 60 meters per minute; the web travels at a speed of at least 80 meters per minute; the web travels at a speed of at least 150 meters per minute; and the web of material travels at a speed of at least 300 meters per minute. These embodiments may yet further comprise a method wherein the roll is coreless; the web comprises a wet-formed basesheet; the web comprises a non-woven basesheet; the web comprises a water-dispersible binder; the method is performed in an environment which is substantially free of contaminants; and the wetting solution is uniformly distributed in the wet web.

In an embodiment of the invention there is provided a method of making wet rolls, comprising providing a web of material from a source; controlling the draw of the web from the source; perforating the web; positioning the perforated web adjacent a wetting apparatus; applying a wetting solution to at least one side of the web with an add-on of at least about 25% to yield a wet web; and winding the wet web into a roll.

These embodiments may further comprise a method wherein the providing comprises obtaining a roll of web material, and unwinding the roll; combining at least two web plies into a single web; and manufacturing a basesheet, and feeding the basesheet to an apparatus for wetting and winding the web. These embodiments may yet further comprise a method wherein the web travels at a speed of at least 60 meters per minute; wherein the wetting solution comprises salt; wherein the positioning, applying, and winding are performed in an environment which is substantially free of contamination; and wherein the roll is coreless.

These embodiments may yet further comprise a method wherein the wetting solution is applied at an add-on between about 25% and about 700%; the wetting solution is applied at an add-on between about 50% and 400%; the wetting solution is applied at an add-on between about 100% and 350%; the wetting solution is applied at an add-on between about 150% and 300%; and the wetting solution is applied at an add-on between about 200% and 250%.

In an embodiment of the invention there is provided a method of making a wet coreless roll comprising: a) providing a wet web of material; b) breaking the wet web and forming a cigarette from the leading edge of the break; c) forming a roll of the wet web around the cigarette in a roll forming pocket; d) separating the wet web roll from the web while repeating step b); and e) discharging the separated wet web roll from the roll forming pocket. These embodiments may further comprise perforating the web, and making the break of step b) along a line of perforation.

These embodiments may yet further comprise a method wherein the roll forming pocket comprises a first roller, a second roller, and a third roller. These embodiments may yet further comprise a method wherein the roll forming pocket comprises a first roller, a second roller, and a third roller; the wet web contacting the first roller, the second roller, and the third roller; the first, second and third rollers rotating in the same circular direction; and the second roller rotating in a circular direction opposite from the direction of movement of the wet web. These embodiments may further comprise a method wherein the method is performed in an environment which is substantially free of contaminants; wherein the web travels at a speed of at least 60 meters per minute; and wherein the wet web comprises an add-on of a wetting solution of at least about 25%.

In an embodiment of the invention there is provided a method of making wet coreless rolls comprising providing a wet web; winding the wet web into a roll using a roll forming pocket; the roll forming pocket comprising a first roller, a second roller and a third roller; the wet web contacting the first roller, the second roller, and the third roller; the first, second and third rollers rotating in the same direction; and the second roller rotating in a direction opposite from the direction of movement of the wet web; and discharging the wet web roll from the roll forming pocket.

These embodiments may further comprise a method wherein the wet web is made by applying a wetting solution to a basesheet; wherein the wetting solution comprises salt; and wherein the method is performed in an environment which is substantially free of contaminants.

These embodiments may yet further comprise a method wherein the wetting solution is applied at an add-on greater than about 25%; wherein the wetting solution is applied at an add-on between about 25% and about 700%; the wetting solution is applied at an add-on between about 50% and 400%; the wetting solution is applied at an add-on between about 100% and 350%; the wetting solution is applied at an add-on between about 150% and 300%; and the wetting solution is applied at an add-on between about 200% and 250%.

In an embodiment of the invention, there is provided an apparatus for wetting and winding a substrate, comprising means for applying a wetting solution to the substrate to form a wet substrate; and means for winding coreless rolls of the wet substrate.

These embodiments may further comprise a means for perforating the substrate. These embodiments may yet further comprise an apparatus wherein the means for applying a wetting solution distributes the wetting solution evenly along the substrate; wherein the means for applying a wetting solution comprises a means for increasing the absorption rate of the solution in the substrate; wherein the wetting solution is present in the wet substrate in an add-on of at least about 25%; and wherein the apparatus is in an environment which is substantially free of contaminants.

In an embodiment of the invention there is provided an apparatus for wetting and winding a substrate, comprising a wetting apparatus; and a winding apparatus; wherein the winding apparatus can form wet coreless rolls with an add-on of at least about 25%. These embodiments may further comprise a perforating apparatus and a detour roller.

These embodiments may yet further comprise an apparatus wherein the wetting apparatus is a fluid distribution header; wherein the wetting apparatus is a spray boom; wherein the wetting apparatus comprises a drool bar; wherein the wetting apparatus comprises press rolls; and wherein the winding apparatus comprises an upper winding roller, a lower winding roller, a rider roller and a transfer shoe.

In an embodiment of the invention there is provided a method of winding a wet web, comprising providing a wet web of material; applying a wetting solution to the web to produce a wet web, the wetting solution comprising a salt, preferably an inorganic salt; and winding the wet web into a wet roll; wherein the variability of the salt throughout the wet roll is less than about 20%.

These embodiments may further comprise a method, wherein the variability of the salt is less than about 10%, less than about 5%, and less than about 3%; wherein the wetting solution further comprises at least one preservative, the variability of each preservative throughout the wet roll being less than about 60%.

In an embodiment of the invention there is provided a method of making wet rolls, comprising providing a web of material; applying a wetting solution to the web to produce a wet web, the wetting solution comprising at least one preservative; and winding the wet web into a wet roll; wherein the variability of each preservative throughout the wet roll is less than about 60%.

These embodiments may further comprise a method, wherein the variability of the salt is less than about 50%, less than about 40%, and less than about 35%.

In an embodiment of the invention there is provided a method of making wet rolls, comprising providing a web of material; applying a wetting solution to the web to produce a wet web, the wetting solution comprising a salt, preferably an inorganic salt, at least one preservative; and winding the wet web into a wet roll; wherein the variability of the salt throughout the wet roll is less than about 10%, and the variability of each preservative throughout the wet roll is less than about 50%.

These embodiments may further comprise a method, wherein the variability of the salt throughout the wet roll is less than about 5%, and the variability of each preservative throughout the wet roll is less than about 40%; wherein the variability of the salt throughout the wet roll is less than about 3%, and the variability of each preservative throughout the wet roll is less than about 35%; wherein the variability of the salt throughout the wet roll is at most about 2.5%, and the variability of each preservative throughout the wet roll is at most about 32.5%; wherein the salt is sodium chloride; wherein the preservative comprises a substance selected from the group consisting of IPBC, DMDM Hydantoin, and malic acid; wherein the preservative comprises IPBC, DMDM Hydantoin, and malic acid; wherein the web comprises a water-dispersible binder; and wherein the wet roll is coreless.

In an embodiment of the invention there is provided a wet coreless roll, comprising a basesheet; a salt, preferably an inorganic salt; and at least one preservative; wherein the variability of the salt throughout the wet roll is less than about 20%, and the variability of each preservative throughout the wet roll is less than about 60%.

These embodiments may further comprise a wet coreless roll, wherein the variability of the salt throughout the wet roll is less than about 10%, and the variability of each preservative throughout the wet roll is less than about 50%; wherein the variability of the salt throughout the wet roll is less than about 5%, and the variability of each preservative throughout the wet roll is less than about 40%; wherein the variability of the salt throughout the wet roll is less than about 3%, and the variability of each preservative throughout the wet roll is less than about 35%; wherein the salt is sodium chloride; wherein the preservative comprises a substance selected from the group consisting of IPBC, DMDM Hydantoin, and malic acid; wherein the preservative comprises IPBC, DMDM Hydantoin, and malic acid; and wherein the basesheet comprises a water-dispersible binder.

In an embodiment of the invention there is provided a wet coreless roll prepared by a process comprising: providing a web of material; applying a wetting solution to the web to produce a wet web, the wetting solution comprising a salt, preferably an inorganic salt; at least one preservative; and winding the wet web into a wet roll.

These embodiments may further comprise a wet coreless roll, wherein the variability of the salt throughout the wet roll is less than about 20%, and the variability of each preservative throughout the wet roll is less than about 60%; wherein the variability of the salt throughout the wet roll is less than about 10%, and the variability of each preservative throughout the wet roll is less than about 50%; wherein the variability of the salt throughout the wet roll is less than about 5%, and the variability of each preservative throughout the wet roll is less than about 40%; wherein the variability of the salt throughout the wet roll is less than about 3%, and the variability of each preservative throughout the wet roll is less than about 35%; wherein the salt is sodium chloride; wherein the preservative comprises a substance selected from the group consisting of IPBC, DMDM Hydantoin, and malic acid; wherein the preservative comprises IPBC, DMDM Hydantoin, and malic acid; and wherein the web of material comprises a water-dispersible binder.

In an embodiment of the invention there is provided a wet coreless roll, comprising a basesheet comprising a water-dispersible binder; sodium chloride; and at least one preservative selected from the group consisting of IPBC, DMDM Hydantoin, and malic acid; wherein the variability of the salt throughout the wet coreless roll is less than about 5%, and the variability of each preservative throughout the wet roll is less than about 40%.

In an embodiment of the invention there is provided a method of winding a wet web, comprising providing a wet web of material; pinning said wet web against a low friction surface; sliding said wet web across said low friction surface toward a high friction surface; contacting said wet web against said high friction surface; moving said wet web across said high friction surface to form a bunched portion of the web; and winding the wet web around the bunched portion.

DETAILED DESCRIPTION

A method for making wet rolls is provided which in general includes winding a wet substrate into a wet roll. The method may provide for even distribution and absorption of a fluid throughout a substrate to provide the wet substrate. The method may include winding a substrate that has a fluid add-on of at least about 25%. An apparatus for performing the method is also provided.

Figure 1:
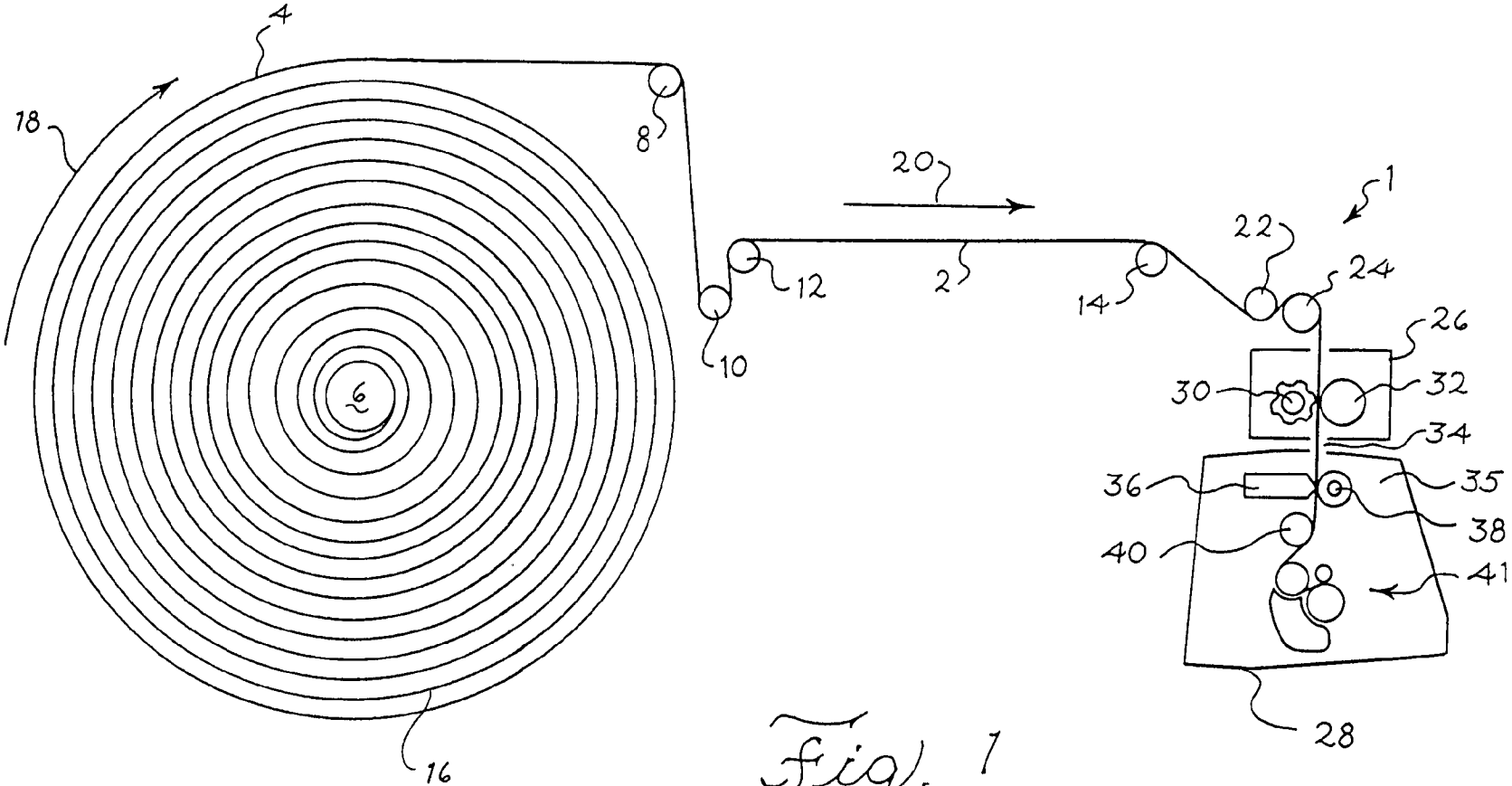
FIG. 1 is a diagrammatic view of an apparatus connected to a parent roll.

Referring to FIG. 1, there is in general provided a web of material 2. This source web may be any type of basesheet known to those skilled in the art. For example, the web may be a wet-formed basesheet such as a tissue or towel basesheet. The web may be a non-woven basesheet, such as an airlaid, spun-laid, hydroentangled, spun-bond, or melt-blown basesheet. The web may be a multi-layer basesheet, such as a laminate of any combination of these basesheets. The basesheet may contain a binder, for example a non-dispersible binder, such as a latex binder or a cross-linkable binder; or a water-dispersible binder, such as a temperature-sensitive water dispersible binder or an ion-sensitive water dispersible binder. Ion-sensitive water-dispersible binders, such as those disclosed in the above-referenced co-pending patent applications, provide for water dispersibility of 80% or greater. Water dispersibility is defined as: 1 minus (the cross-direction wet tensile strength in water, divided by the original cross-direction wet tensile strength of the wet wipe), multiplied by 100%. Examples of individual webs include a melt-blown basesheet with a latex binder; a spun-bond basesheet with a temperature-sensitive water dispersible binder; and an airlaid basesheet with an ion-sensitive water dispersible binder.

The web is delivered to the wetting and winding apparatus 1 as a sheet of material. The web may be unwound from a roll, or it may be fed to the apparatus directly from a web making apparatus. The web may be a single sheet, or the web may have multiple sheets which are combined to form a multi-ply sheet. Multi-ply sheets may be bonded together, for example with adhesives, thermal bonding, sonic bonding, or hydroentanglement. Referring to FIG. 1, the web may be dispensed from a parent roll 4 which can be mounted on a rotating shaft 6. The spiral wind 16 of the parent roll allows the roll to be unwound in the direction of arrow 18. The unwinding of the roll can be controlled such that the web is dispensed at a consistent speed and tension even though the size of the roll is decreasing. The web is delivered in the form of a sheet to the wetting apparatus 35 in the direction of arrow 20. The delivery may be controlled by a series of rollers (8, 10, 12, 14, 22, 24) to adjust the speed of the delivery and/or the tension applied to the web. These rollers may independently be, for example, dancer rollers, idler rollers, draw rollers, or bowed rollers. The speed of the web may be at least 60 meters per minute (m/min). Preferably, the speed of the web is at least 80 m/min; more preferably at least 150 m/min; more preferably still at least 300 m/min.

Figure 2:
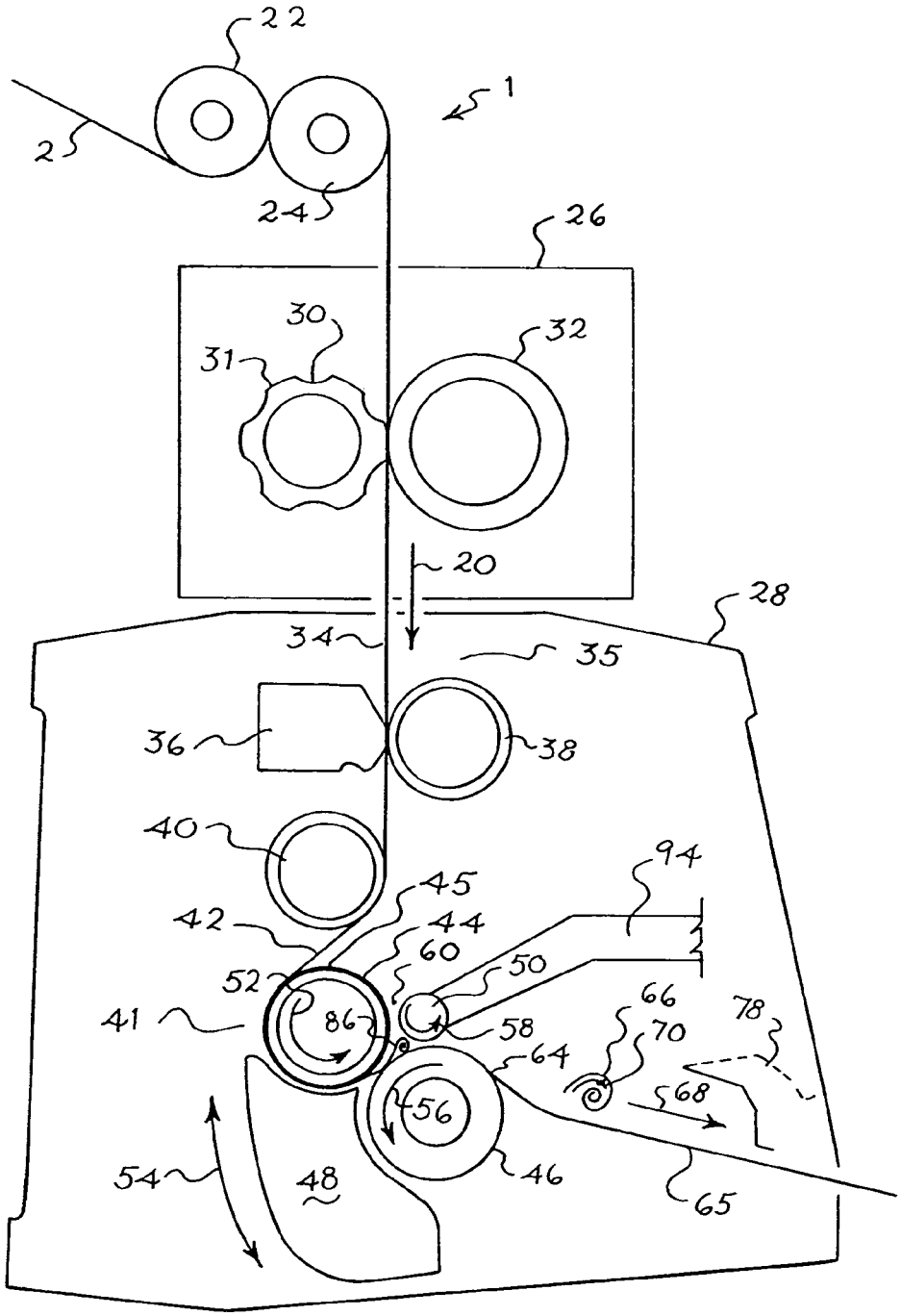
FIG. 2 is a diagrammatic view of the wetting and winding apparatus of FIG. 1.
Figure 3:
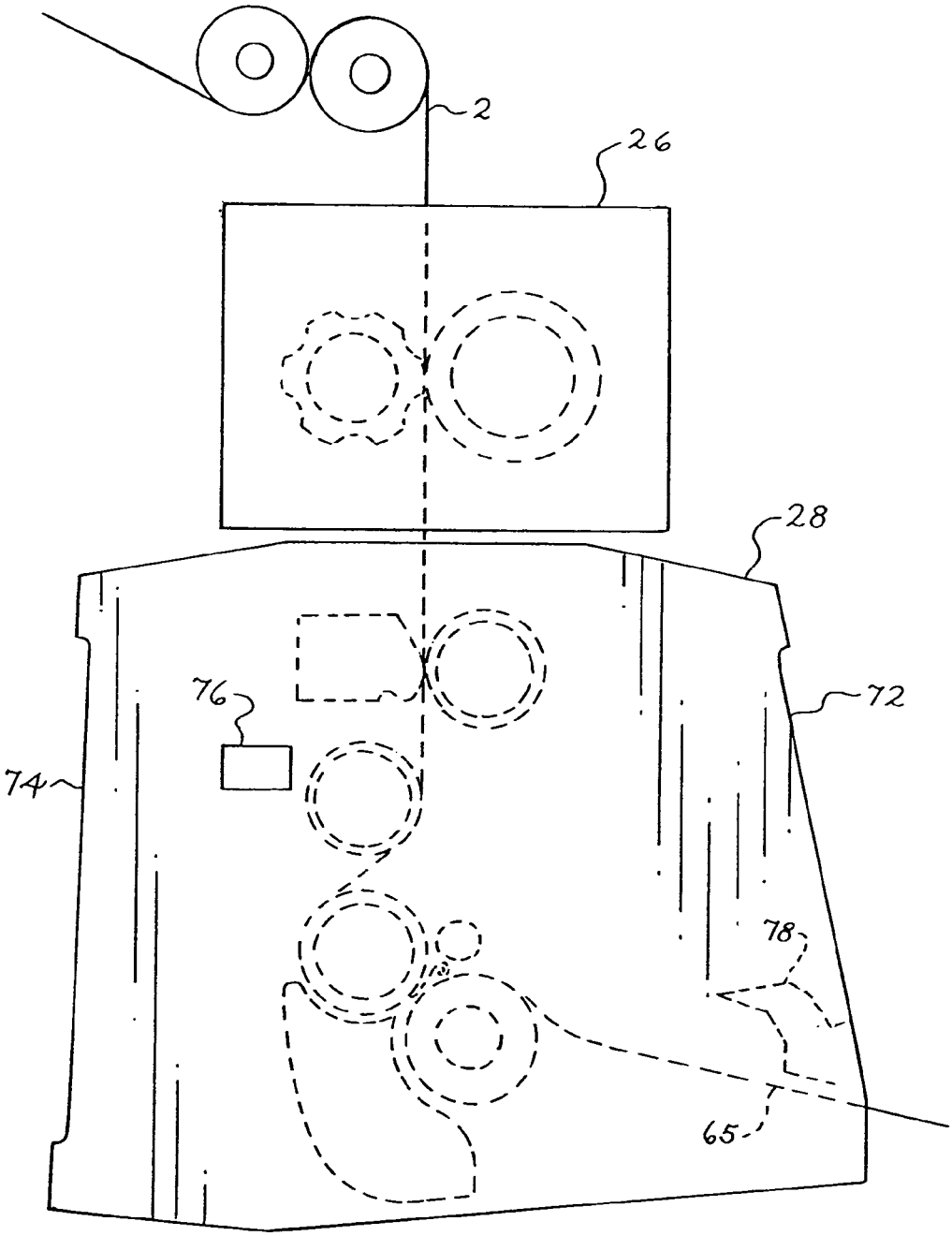
FIG. 3 is a diagrammatic view of housings for the wetting and winding apparatus of FIG. 2.

There may optionally be a device for perforating the web. Referring to FIG. 2, the perforation may be accomplished by a pair of rollers 30 and 32, wherein at least one of the rollers 30 comprises a series of teeth or blades 31 such that the impact of the rollers on the web results in incisions in a line forming a perforation line. The incisions within the perforation line may be spaced regularly, they may be spaced randomly, or they may be spaced in a controlled arrangement. The perforations are preferably in the cross direction (CD) of the web; that is in the plane of the web perpendicular to the direction of movement, or the machine direction (MD). The perforating rollers optionally may be contained in a housing 26, as illustrated in FIGS. 1–3.

The perforation may be accomplished by methods known to those skilled in the art. For example, a perforating apparatus as described in U.S. Pat. No. 5,125,302, incorporated herein by reference, may be used to perforate the web. The perforating apparatus may contain a rotating perforation roll and a stationary anvil bar. The perforation roll in this case has multiple rows of blades along the CD of the roll, and these blades protrude slightly from the face of the roll. The space between these rows and the length of the blades dictates the perforation length and spacing. The anvil bar is typically configured as a helix, for example a double helix or single helix, such that it contacts the perforation blades only at one or two positions at a time. Thus, as the perforation roll rotates, the web becomes perforated across the entire web. The web typically wraps the rotating perforation roll. The perforating apparatus may contain a rotating anvil roll with a stationary perforation blade. Typically, multiple anvil bars are configured in a helix around the anvil roll and engage the perforation blade. The web is perforated in one location at any one time. The web does not typically wrap either the anvil roll or the perforation blade. Also, the anvil roll may be kept stationary and the perforation blade may be rotated on a roll.

Referring to FIG. 2, a wetting solution may be applied to the web by wetting apparatus 35, and the wet web 42 is then delivered in the direction of arrow 20 to the wet winding apparatus 41. This delivery may be accomplished by the use of rollers or belts such as roller 40. Care must be taken in handling the wet web since the presence of moisture in the web can alter the physical properties of the material. For example, incorporation of 225% by weight of a wetting solution can increase the percent elongation at failure (i.e. "stretch") of a web from 5–10% to 25–40%. In general, the strength of the web is also decreased upon application of a given wetting solution. Typically, perforations also will diminish the strength of the wet web.

The wet winding apparatus may be any winding apparatus known to those skilled in the art. The wet winding apparatus may, for example, wind a web around a removable mandrel to produce a coreless material (U.S. Pat. Nos. 5,387,284; 5,271,515; 5,271,137; 3,856,226). The winding apparatus may, for example, wind a web around a tubular or cylindrical core (U.S. Pat. Nos. 6,129,304; 5,979,818; 5,368,252; 5,248,106; 5,137,225; 4,487,377). The winding apparatus may, for example, be a coreless surface winder which can produce coreless rolls without the use of a mandrel. (U.S. Pat. Nos. 5,839,680; 5,690,296; 5,603,467; 5,542,622; 5,538,199; 5,402,960; 4,856,725). The above applications are incorporated herein by reference.

Referring to FIG. 2, a coreless surface winder for the wet web in general can provide for continuous winding of wet coreless rolls 66. The wound roll 66 is separated from the wet web when the web is broken by the winder. It is desirable, although not required, that each roll produced by this apparatus under a given set of conditions has substantially the same number of sheets (as defined by lines of perforations) and substantially the same dimensions. The wound wet rolls are then collected or delivered for storage or further processing. The collection or delivery may be accomplished by the use of a conveyor, a collection bin, or a metering device 78 for dispensing the rolls to another apparatus.

The wetting and winding apparatus 35 and 41 may be enclosed in a containment box 28 to which the web 34 is delivered. Such a box serves to contain the wetting solution and to maintain a sanitary environment around the wet web. The area outside the box, including the dry components of the apparatus 1 and other equipment, is shielded from contact with the wetting solution. Thus, the workspace outside the box remains safe and easy to service. Containment of the wetting solution also provides for recovery of any excess solution that is not absorbed by the web. Recovered wetting solution may or may not be recycled depending on sanitary considerations. Excess wetting solution can be removed from the box by way of a drain. The drain can also provide for removal of any liquids used for cleaning the apparatus.

The setup of the wetting and winding apparatus and the containment box may be performed in an environment that is controlled to minimize airborne contaminants. The box can thus maintain the wetting and winding apparatus, the wet web, and the resultant wet rolls, in an environment which is substantially free of contaminants. Environmental parameters which may be controlled include air circulation and filtration, temperature, and humidity. The apparatus and the box may be sanitized on a periodic basis. The wetted areas inside the box may be treated with cleaning agents to eliminate any contamination, such as mold, fungus, or bacterial growth. The wetted areas may further be rinsed with clean, preferably ozonated, water, and then dried and/or treated with alcohol, such as isopropanol. Any components outside the box that come into contact with the basesheet are also preferably sprayed or wiped with alcohol. The size of the box may be large enough to allow access to the components inside the box, yet not so large that liquid could collect and contribute to contamination. In the embodiment illustrated in FIG. 3, physical access can be obtained by way of doors 72 and 74 on the sides of the box. The apparatus and the quality of the environment within the box may be monitored by way of corrosion-resistant windows 76, such as polycarbonate. The containment box may be constructed of any material which is not susceptible to corrosion, such as stainless steel. The box may be ventilated, depending on the characteristics of the wetting solution.

The wetting apparatus 35 includes a device for solution application and, optionally, a support for the web. The support may be an air plate, a set of belts or a backing roller 38. The support may be stationary, as in the case of an air plate; or it may be movable, as in the case of a roller. The support should be constructed of corrosion resistant material such as stainless steel or chrome. In the embodiment shown in FIG. 2, a backing roller 38 is adjustably mounted near the solution applicator. The roller may rotate idly or may rotate at a given speed, such as the speed of the web.

It is desirable to have even distribution of the wetting solution throughout the web in all directions. This homogenous wetting has many advantages. It can help to minimize or eliminate differences in physical properties within the web, such as strain and strength characteristics, allowing for reproducible processing of the wet product. It can help to minimize colonization and growth of contaminants. It can help to ensure consistent product quality; that is, a given roll of wet wipes will have substantially the same characteristics as another roll of wet wipes produced under specific operating conditions.

Even application of the wetting solution can help to provide uniform distribution of the ingredients initially present in the solution, such as dispersibility agents, preservatives, fragrances, or other additives. The distribution of ingredients may be uniform within the web of material in both the cross-direction and the machine-direction. Wet rolls made from such a web then may also have a uniform distribution of ingredients, and this uniformity may be consistent within a roll (i.e. from the outside to the center, and from one end of the roll to the other) or from one roll to another. A uniform distribution of ingredients provides for consistent storage and dispensing characteristics of a roll of wet wipes. For example, the entire roll can be equally protected from contamination if there is uniform distribution of a preservative. In another example, the roll can be dispensed acceptably regardless of the number of sheets which remain in the roll. Dispensing characteristics include, for example, peel strength, tensile strength, and perf strength, as defined in the above mentioned U.S. application Ser. No. 09/659,307. These may be independently affected by the distribution of the wetting solution.

Examples of wetting solutions are given in the above mentioned U.S. U.S. Pat. Nos. 6,683,143; 6,429,261; 6,599,848; 6,444,214; 6,713,414; 6,548,592; 6,579,570; 6,653,406; and 6,537,663; and application Ser. Nos. 09/565,125 and 09/564,531. Preferably, the wetting solution is added to the web with an add-on greater than about 25%. The amount of liquid or wetting solution contained within a given wet web can vary depending on factors including the type of basesheet, the type of liquid or solution being used, the wetting conditions employed, the type of container used to store the wet wipes, and the intended end use of the wet web. Typically, each wet web can contain from about 25 to about 600 weight percent and desirably from about 200 to about 400 weight percent liquid based on the dry weight of the web. To determine the liquid add-on, first the weight of a portion of dry web having specific dimensions is determined. The dry web corresponds to the basesheet which can be fed to the wetting and winding apparatus. Then, the amount of liquid by weight equal to a multiple (e.g. 1,1.5, 2.5, 3.3, etc., times) where 1=100%, 2.5=250%, etc., of the portion of the dry web, or an increased amount of liquid measured as a percent add-on based on the weight of the dry web portion, is added to the web to make it moistened, and then referred to as a "wet" web. A wet web is defined as a web which contains a solution add-on between 25% and 700%; more preferably between 50% and 400%; and more preferably still between 100% and 300%; more preferably still between 200% and 250%.

Complete absorption of the wetting solution helps to minimize the amount of excess liquid on the web and thus on the components of the apparatus. The term "complete absorption" refers to the absorption of liquid by a material such that no liquid will freely drop from the material when the material is held vertically for 30 seconds. The wetting and winding apparatus may be separated by a distance such that the wetting solution can be completely absorbed by the web as it travels between the wetting apparatus and the winding apparatus. This travel time may range from less than one second to about one minute. The rate of absorption can depend on many factors, including the type of basesheet, the characteristics of the binder, and the composition used as the wetting solution.

The configuration of the wetting and winding apparatus may, however, be limited, for example by space constraints or other manufacturing considerations. If there is not a sufficient distance between the apparatus, it may be desirable that the wetting solution is absorbed in a shorter time than is necessary for absorption due to simple contact between the web and the wetting solution. Higher rates of absorption can allow for higher machine speeds and increased product throughput.

Numerous parameters may be controlled in order to influence the degree and/or rate of absorption of the wetting solution, as well as the amount of solution that is wasted and/or recycled. These parameters include, for example the solution add-on level, the temperature of the wetting solution, the geometry of impingement of the solution, and the pressure applied to the web during and/or after the solution application. Ideally, the wetting solution impinges evenly along the entire cross-direction of the web.

Figure 4:
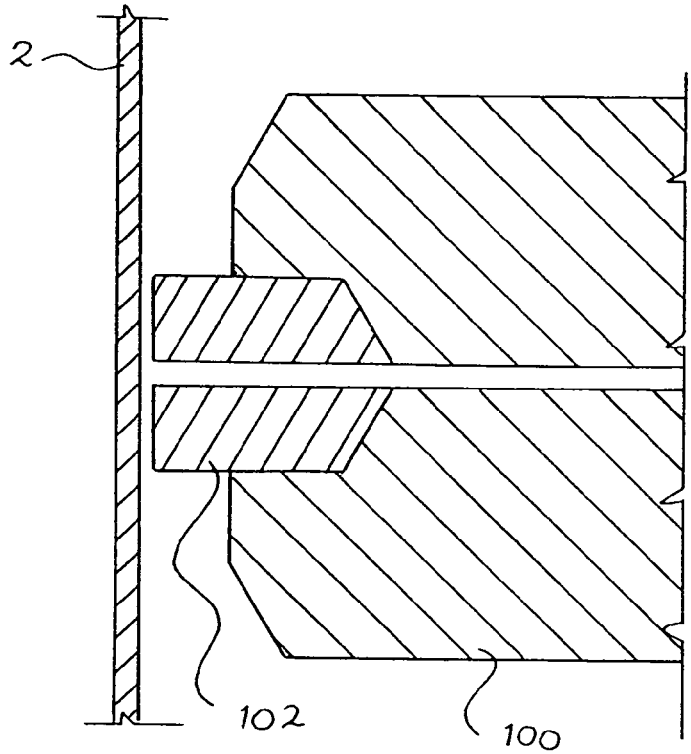
FIG. 4 is a diagrammatic view of a fluid distribution header.

The wetting solution can be applied by methods known to those skilled in the art. The wetting apparatus may contain, for example, a fluid distribution header, such as a die with a single orifice; a drool bar; a spray boom, such as a boom with multiple nozzles; or press rolls. The apparatus may contain, for example, a fluid distribution header 100 with an adjustable die 102 (FIG. 4). The size of the orifice in the die, the temperature of the die, and the volume of solution applied may be controlled such that the liquid exits the die with a uniform pressure, temperature, and geometry.

Figure 5:
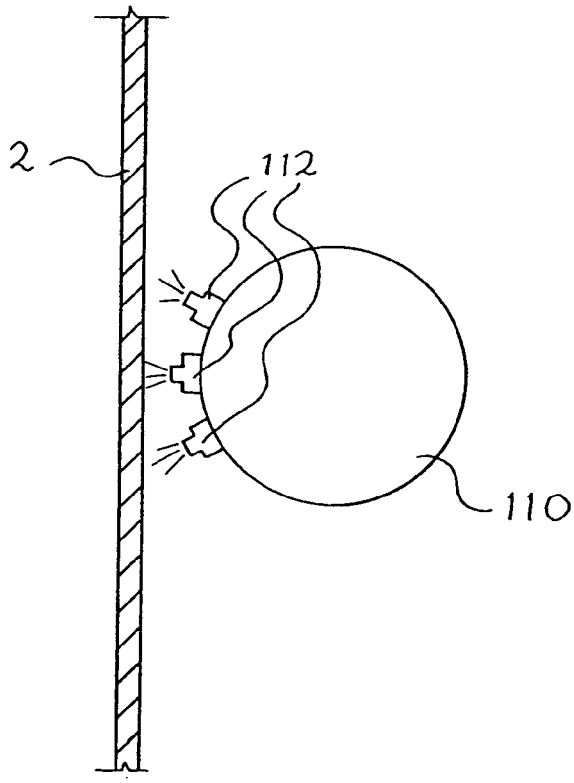
FIG. 5 is a diagrammatic view of a spray boom.
Figure 15:
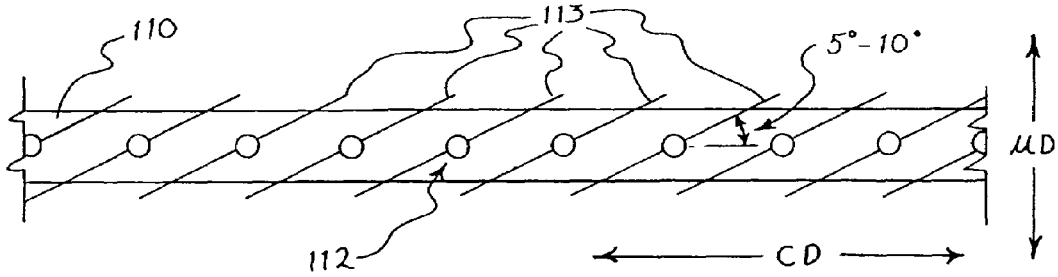
FIG. 15 is a diagrammatic view of a spray boom.

The apparatus may contain a spray boom 110 with multiple nozzles 112 (FIG. 5). The distribution of the nozzles along the boom, as well as their orientation with respect to the web, may be adjusted to provide for substantially uniform application of liquid. For example, the spray boom may include a pipe which extends across the cross-direction of the web. This pipe may have nozzles across its length which spray the wetting solution onto the web. The distance between the individual nozzles and the distance between the nozzles and the web can affect the uniformity of application of the solution. It is desirable that the sprays from the nozzles do not interfere with each other when impinging the web. To help prevent this interference, it may be beneficial for the nozzles to be "shingled." That is, the orientation of the nozzles may be rotated from being in line with each other in the cross-direction. Referring to FIG. 15, the nozzles 112 may be arranged in a single line and may be rotated 5–10 degrees from the cross-direction line so that the sprays 113 do not physically interfere with each other. The amount of solution delivered to the boom and its nozzles may be adjusted according to the speed of the web. Thus, a uniform amount of solution may be applied, not only in the cross-direction, but also in the machine-direction regardless of the speed of the web. For high machine speeds, it may be desirable to use nozzles having larger orifices and/or to utilize more than one spray boom. Multiple spray booms may be employed to deliver amounts of solution which are different or which are the same.

Figure 6:
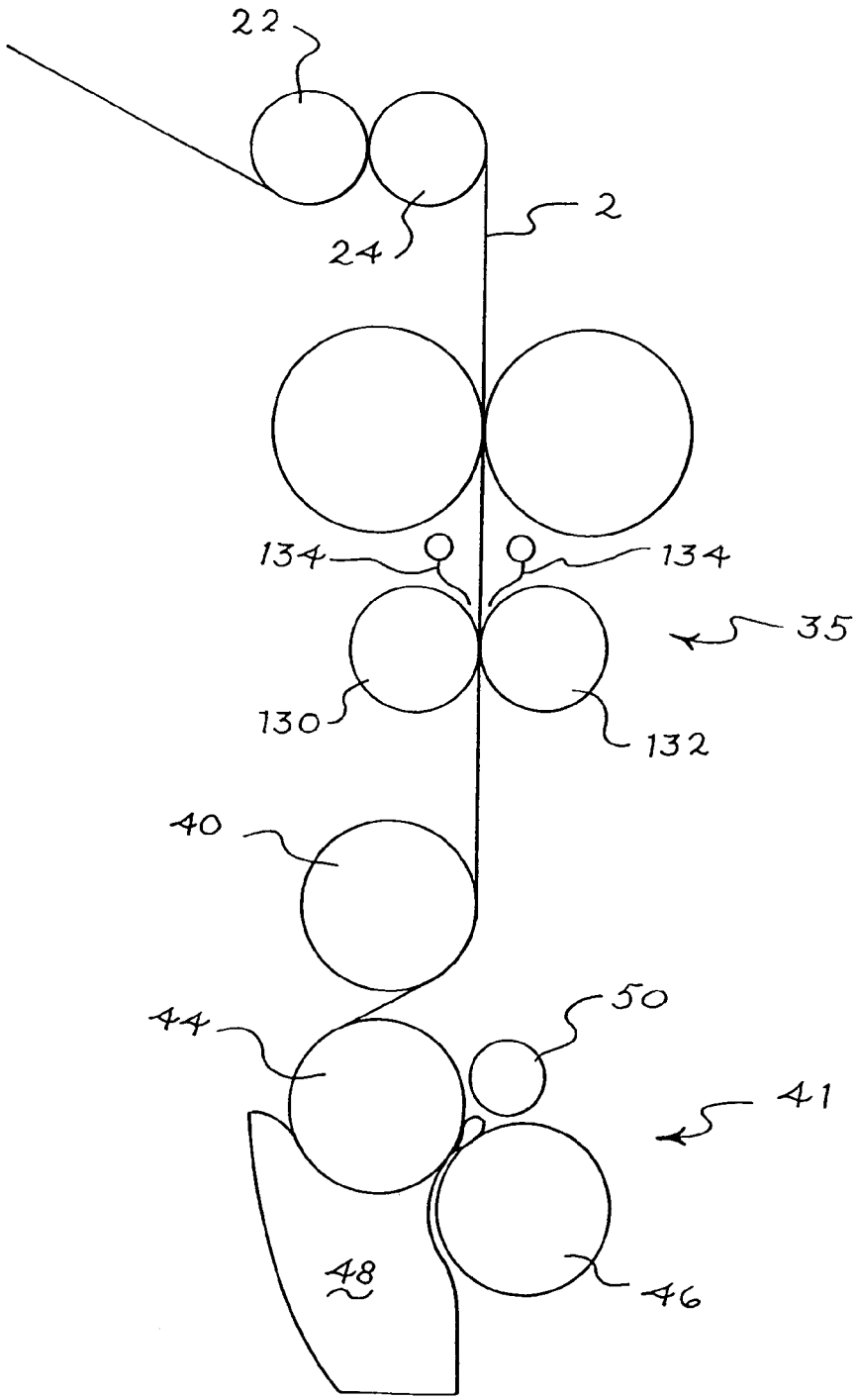
FIG. 6 is a diagrammatic view of a wetting and winding apparatus with press rolls.

Referring to FIG. 6, the wetting apparatus may optionally include a set of press rolls. For example, the press rolls 130 and 132 may be rubber-covered rolls positioned to contact the web. The wetting solution 134 may be applied to the web, for example by a fluid distribution header or a spray boom. The wetting solution may also be applied to the press rolls, for example by a set of drool bars. The press rolls may be configured to apply force to the web, such that the solution is forced into the basesheet. This can help prevent a film of excess solution from forming on the surface of the sheet. The interaction of the press rolls with the web may be modified as needed to provide for complete solution absorption. For example, the press rolls may be removed from contact with the web if the absorption is sufficiently complete without added pressure. The press rolls may, for example, contact the web with a pressure that is controllable and which can be adjusted to modify the rate of absorption.

Figure 9:
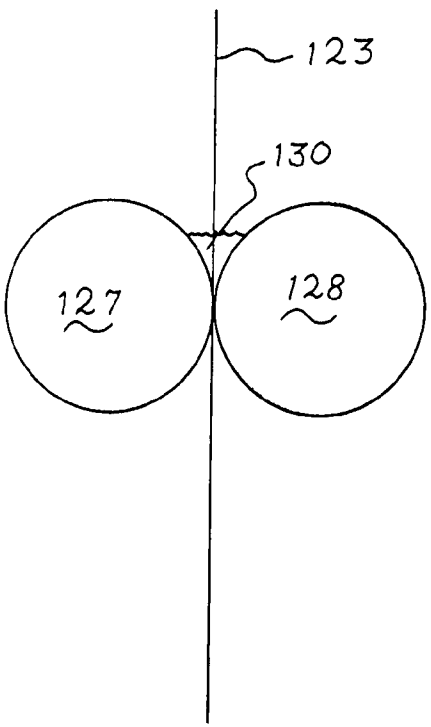
FIGS. 7–9 are diagrammatic views of nips for a wetting apparatus.
Figure 8:
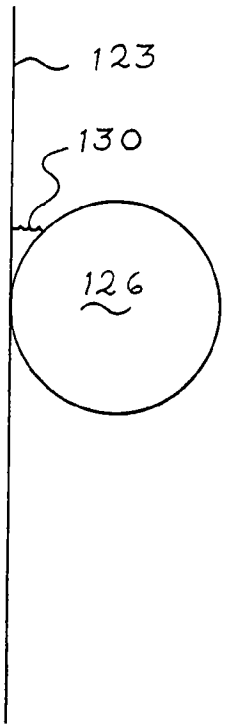
Figure 7:
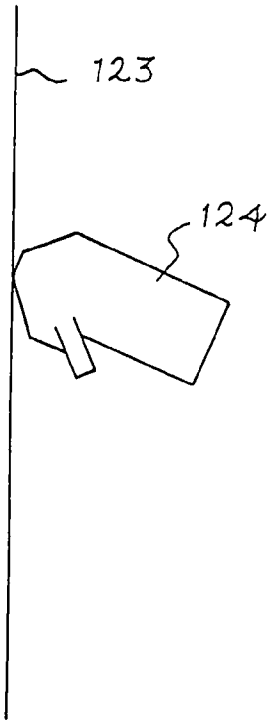
Figure 10:
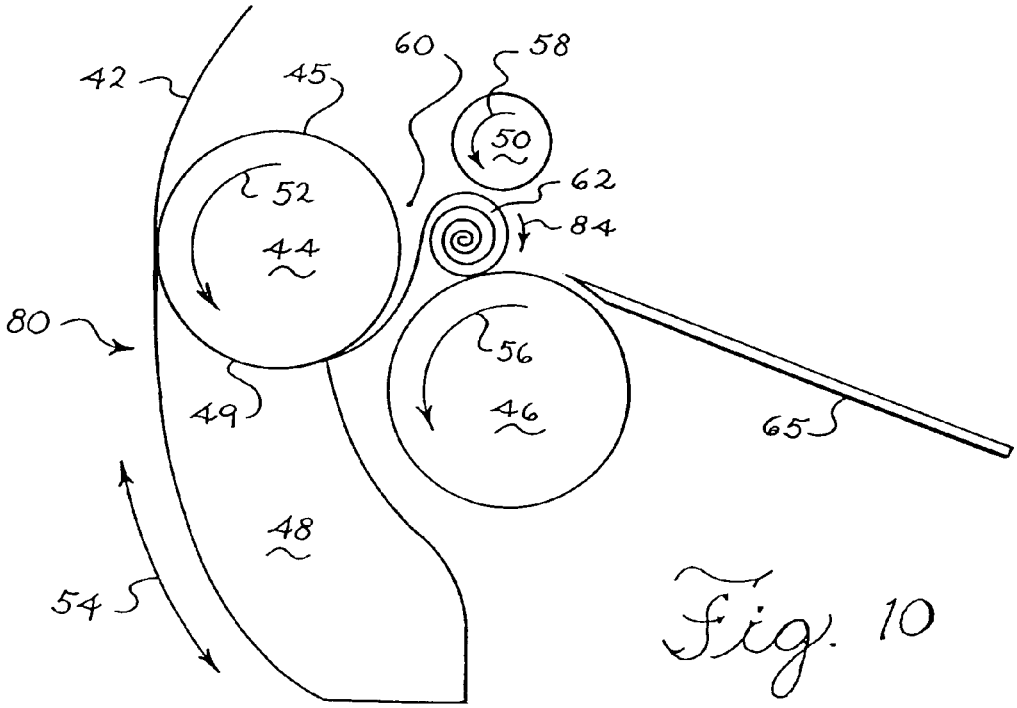
FIGS. 10–11 are diagrammatic views of a wet winding apparatus.

The wetting apparatus may include the use of a nip to improve distribution and absorption. A nip may be formed by the convergence of a web 123 and a header 124 (FIG. 7), a web 123 and a roller 126 (FIG. 8), or two rollers 127 and 128 (FIG. 9). In these embodiments, the application of fluid 130 is controlled by parameters including the distance between the elements forming the nip. Solution application may be accomplished by the use of other apparatus known to those skilled in the art. For example, the web may be passed through a bath or trough containing the wetting solution. The web may be wetted by contact with a material that is wet, such as a wetted belt or roller or a wet sponge. The application of solution may be accomplished in more than one step; that is by two or more wetting steps, which may be the same or different.

The application of a uniform amount of wetting solution to the web before winding the web into a roll can provide for a uniform distribution of ingredients throughout the roll. This, in turn, can provide for consistent product quality (i.e. from roll to roll) as well as for consistent properties of an individual roll which may be used by a consumer. For example, in wet rolls made from a basesheet with an ion-sensitive water-dispersible binder, an even distribution of an inorganic salt, such as sodium chloride (NaCl), potassium chloride (KCl) or potassium bromide (KBr), can ensure that any given portion of a wet roll will disperse in water at an acceptable rate. Also, the presence of a uniform distribution of inorganic salt can ensure that none of the roll will experience a decrease in wet strength, for example, during production, storage, or use. In another example, a set of preservatives may be used in the wetting solution to guard against contamination of the wet roll. Insufficient preservative levels in a portion of a roll can allow the presence and/or growth of contaminants, even if the remainder of the roll is adequately protected. Accumulation of preservative in a portion of a roll can cause the wet sheet to have an undesirable feel and/or wiping properties. An excess of preservative, in some areas of the sheet, could contribute to allergic or irritant contact dermatitis if that area was wiped on the skin. A uniform distribution of ingredients can prevent the occurrence of either of these extremes.

Uniformity of ingredients within a wet roll is determined by analyzing samples of the roll according to the following representative method. The method of analysis of ingredients may be chosen depending on the product to be analyzed, as well as the surrounding environment. The roll is unwound, and the first five sheets, the middle five sheets, and the last five sheets are removed. These sets of sheets correspond the outside portion of the roll, the portion of the roll midway between the outside and the center, and the center of the roll, respectively. Each set of sheets is then folded and cut into three equal sections corresponding to the left, middle, and right of the roll when the roll is viewed perpendicular to its axis. The sections are individually stored in airtight, moisture loss resistant containers. An individual section is placed in a syringe and compressed to express the solution. This solution is then diluted and tested for chloride using ion chromatography and tested for acid using ion-exclusion liquid chromatography. The chloride data can be converted into data for the inorganic salt level. For wipes which do not express sufficient liquid, the section is extracted with 1:1 methanol and water for 12 hours in an orbital shaker. The section from which liquid has been expressed or extracted is dried in an oven at 60° C. for 36 hours to a constant weight. The dried section is extracted with methanol in an orbital shaker for 12 hours. An aliquot of the extract is dried, and the solids are extracted with the mobile phase to be used for liquid chromatography. Liquid chromatography is used to determine the amount of non-acid preservative. For the measurement of IPBC, a section taken directly from the wet roll is dried in an oven at 60° C. for 36 hours to a constant weight and extracted for 4 hours with methanol. An aliquot of the extract is dried, the solids are extracted with the mobile phase, and the amount of IPBC is determined by liquid chromatography.

For a wet roll which was formed by the wetting and winding process and apparatus described herein and using a wetting solution containing sodium chloride as the inorganic salt and containing iodopropynyl butylcarbamate (IPBC), DMDM Hydantoin, and malic acid as the preservatives, the data for the distribution of the inorganic salt and for the distribution of the preservatives are given in Table 1.

TABLE 1

| Sheets/Section | Left | Middle | Right |
|---|---|---|---|
| | Sodium Chloride (%) | | |
| Outer 5 | 4.40 | 4.37 | 4.37 |
| Middle 5 | 4.35 | 4.30 | 4.41 |
| Inner 5 | 4.35 | 4.68 | 4.35 |
| | IPBC (μg/g) | | |
| Outer 5 | 65 | 35 | 39 |
| Middle 5 | 52 | 33 | 26 |
| Inner 5 | 30 | 30 | 35 |
| | DMDM Hydantoin (ppm) | | |
| Outer 5 | 2460 | 2410 | 2390 |
| Middle 5 | 2310 | 2270 | 2300 |
| Inner 5 | 2210 | 2320 | 2220 |
| | Malic acid (ppm) | | |
| Outer 5 | 439 | 495 | 432 |
| Middle 5 | 424 | 428 | 421 |
| Inner 5 | 423 | 433 | 454 |

The variability of the distribution of an ingredient is defined as the standard deviation as a percentage of the average mean value for all the data points obtained. For example, for the sodium chloride data above, the mean value is 4.40 with a standard deviation of 0.11, which is 2.5% of the mean value. Thus, the sodium chloride values have a variability of 2.5%. The variabilities for IPBC, DMDM Hydantoin, and malic acid are 32.5%, 3.7%, and 5.3%, respectively. It is preferred that the inorganic salt has a variability of less than about 20%, more preferably less than about 10%, more preferably still less than about 5%, more preferably still less than about 3%. It is noted that the inorganic salt is considered an additive only when present at a level of at least about 0.5%, more preferably at least about 1.0%. Some inorganic salt may be present in any wetting solution at levels below these loadings, for example due to water impurities or residual cleaning solutions. For the preservatives in the wet roll, it is preferred that all preservatives individually have a variability of less than about 60%, more preferably less than about 50%, more preferably still less than about 40%, more preferably still less than about 35%. The above are examples of the uniformity of addition of ingredients that may be obtained with the present invention. Such uniformity may also be obtained for other additives and types of additives, and this invention is not limited to those additives exemplified above.

Referring to FIGS. 2 and 6, the wetting apparatus may optionally include a detour roller 40 positioned to contact the web after the solution application and before the wet winding. This roller assists in transferring the wet web from the wetting apparatus to the winding apparatus. The detour roller can provide a frictional surface to ensure adequate tension in the web. This can be especially advantageous during the separation of a completely wound wet log from the rest of the web. Also, the detour roller can provide a preferred geometry between the web and the winding apparatus to ensure adequate contact between the wet web and the upper winding roller of the winding apparatus.

Figure 11:
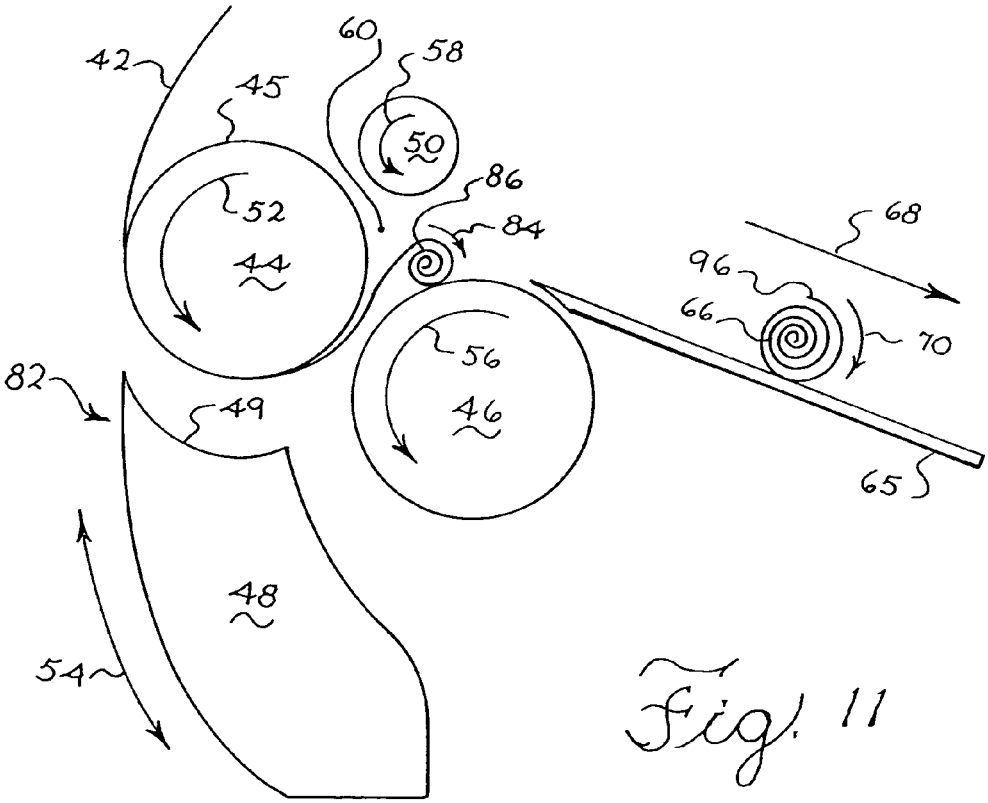
Figure 12:
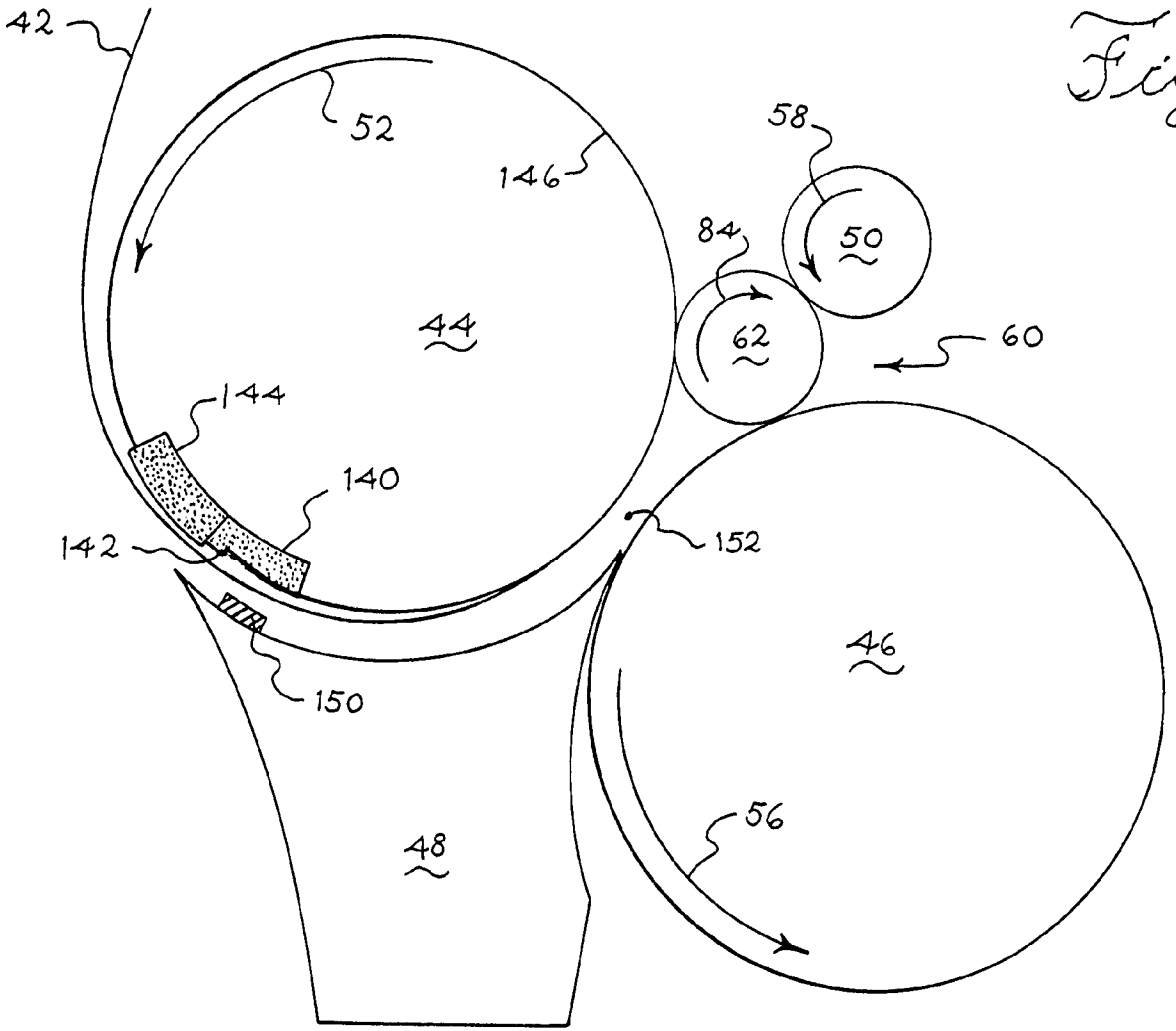
FIG. 12 is a diagrammatic view of the winding rollers and transfer shoe.
Figure 13:
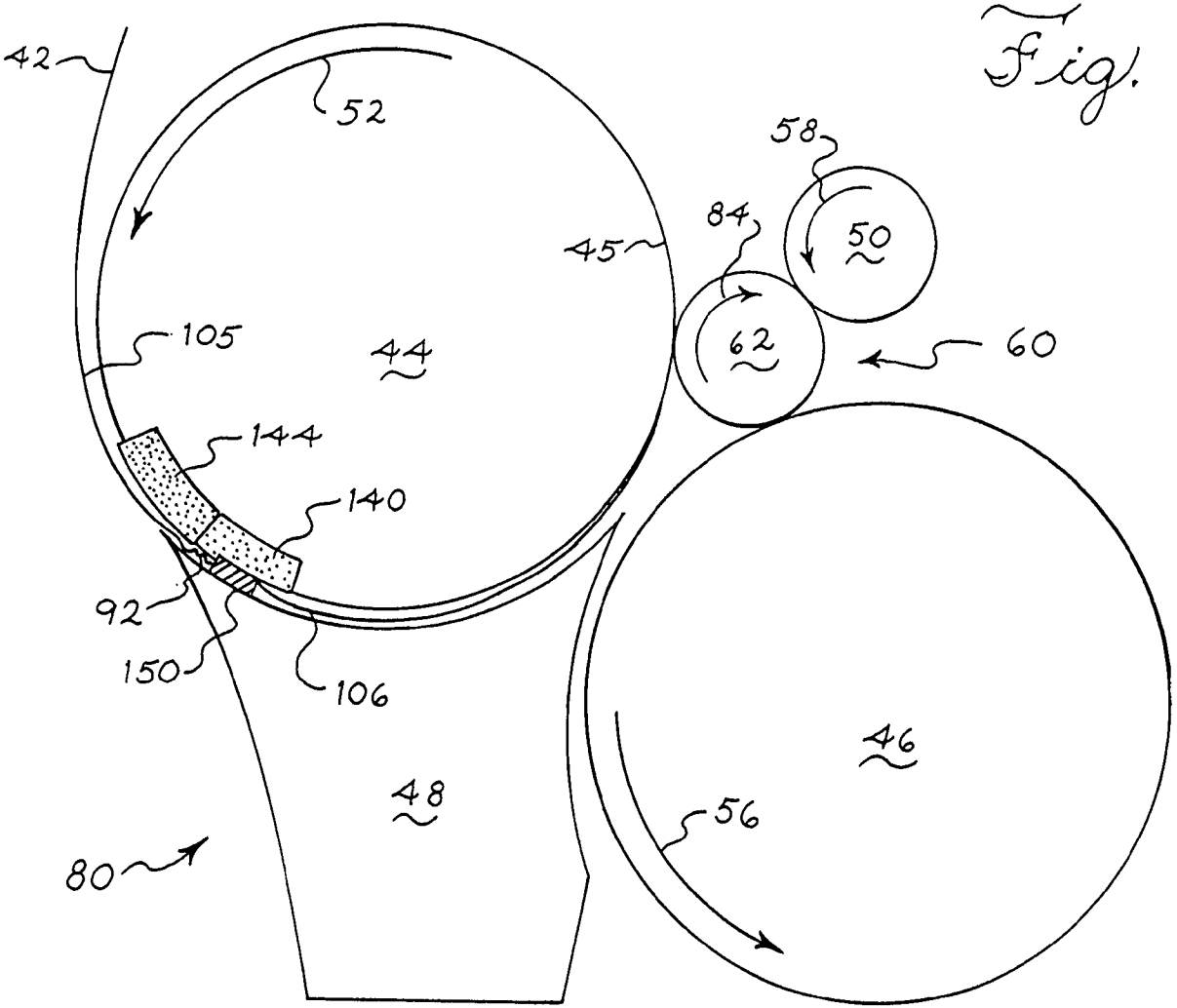
FIG. 13 is a diagrammatic view of the winding rollers and transfer shoe, illustrating the breaking of the web.

Referring to FIGS. 10–13, the wet winding apparatus 41 includes an upper winding roller 44, a lower winding roller 46, and a rider roller 50. The upper winding roller rotates in the direction of arrow 52, so that, when in contact with the wet web, it is moving in the same direction as the web. At a point downstream from the point where the web 42 and the upper winding roller meet, the lower winding roller 46 contacts the exposed side of the web. The lower winding roller rotates in the direction of arrow 56, which is opposite that of the motion of the wet web as it enters the winding pocket. It follows that the upper and lower winding rollers rotate in the same circular direction (i.e. clockwise or counter-clockwise). The contact of both the upper winding roller and the transfer shoe 48 on the web breaks the web into a downstream portion 106 and an upstream portion 105 (FIG. 13). This contact also causes the leading edge of the upstream portion of the web to fold or bunch together into an embryonic roll, called a cigarette 86. The cigarette 86 is caused to rotate in the circular direction 84, which is opposite that of the winding rollers, to form a roll 62. The rider roller 50 is positioned to contact the rotating roll 62 after the point of contact between the winding rollers. The convergence of the rider roller with the winding rollers forms a roll winding pocket 60. The rider roller rotates in the same circular direction 58 as the winding rollers, thus coordinating with the winding rollers to promote rotation of the wet web, in the direction of arrow 84, into a wet roll 62. The rider roller also helps prevent the wet roll from leaving the pocket before a roll of the desired dimensions and/or sheet content is formed.

The upper winding roller preferably has a high friction surface 45 to stabilize the wet web on the roller. A high friction surface is defined as having a surface roughness greater than 250 roughness average (Ra). The friction of a surface can also be quantified in terms of coefficient of friction, in which a higher coefficient of friction corresponds to a higher friction surface. Roughness average is measured by a profilometer, and is based on a graphical centerline, which is the line through the profile of the surface where the sums of the area on either side of the line (peaks and valleys) are equal. Roughness average is defined as the arithmetic average of the height of the peaks above the graphical centerline over a given area, and is expressed in units of microinches (0.000001 inch). The graphical centerline is the least-squares best fit line through the profile data. An example of a profilometer is the Model S5 TALYSURF Surface Profilometer (RANK TAYLOR HOBSON, LTD., Leicester, England). The Ra of a surface can be measured following the procedures described in U.S. Pat. No. 6,140,551, which is incorporated herein by reference, using a single line trace of the surface and a "cut-off" length of 0.8 mm. For example, an 8 mm sampling length would consist of 10 cut-offs of 0.8 mm each.

A presently preferred material for the surface 45 of the upper winding roller is tungsten carbide. Preferably, the surface of the upper winding roller has a roughness of at least about 300 Ra, more preferably at least about 500 Ra, more preferably still at least about 600 Ra, and more preferably still at least about 700 Ra. It is desirable to wind the wet web without the use of vacuum rollers, which contain vacuum ports on their surface to ensure stability of the web. The wetting solution, especially if present in excess (i.e. not fully absorbed by the web), can accumulate on the surface of the web and can also be transferred to the rollers and/or other components of the wet winding apparatus. A high friction surface on the upper winding roll can help to compensate for the decrease in the coefficient of friction of the web due to the presence of the wetting solution. The position of the upper winding roller relative to the detour roller may provide for the web to wrap around a portion of the upper winding roller. Typically, at least 10% of the surface area of the upper winding roller contacts the web. The detour roller preferably has a high friction surface, which may be made of tungsten carbide. More preferably, the surface roughness of the detour roller is at least about 300 Ra, more preferably still at least about 500 Ra.

Referring to FIG. 12, the upper winding roller may also contain two regions which extend across the roller in the cross direction. The downstream region 140 has a smooth surface of stainless steel and has a slightly raised area 142 approximately halfway across the face of the insert. The upstream region 144 is approximately 0.5 mm taller than the raised smooth region. The upstream region also has a plurality of grooves in the cross direction which provide a higher surface roughness than the remainder of the tungsten carbide surface 146. The upstream region may have channels cut into the insert, and these channels may be in the cross-direction and/or the machine direction. Channels in both the cross-direction and the machine-direction may provide an array of flat-top pyramids. For example, the channels may be cut at angles of 60 degrees with a pitch of 1.12 mm, and each flat-top pyramid may have a height of 0.7 mm. The flat surface of the pyramids may further have a tungsten carbide coating to provide a high friction surface.

The coordinated action of the upper winding roller and the transfer shoe 48 on the web results in the beginning of the formation of a log. The transfer shoe is a preferably a rigid material with a high friction surface. The transfer shoe also has a concave surface 49 with a radius of curvature that is substantially the same as that of the upper winding roller. The curvature may be interrupted by a ridge 150. The transfer shoe may be mounted so that it can move along the directions of arrow 54 in an indexing motion. To start the winding of a new log, the transfer shoe is indexed towards the upper winding roller. The shoe is illustrated in the raised position 80 in FIG. 10 and in the lowered position 82 in FIG. 11. The rate and/or frequency of movement of the transfer shoe may be adjustable so as to provide for rolls of different dimensions or to accommodate other substrates or machine speeds.

Figure 14:
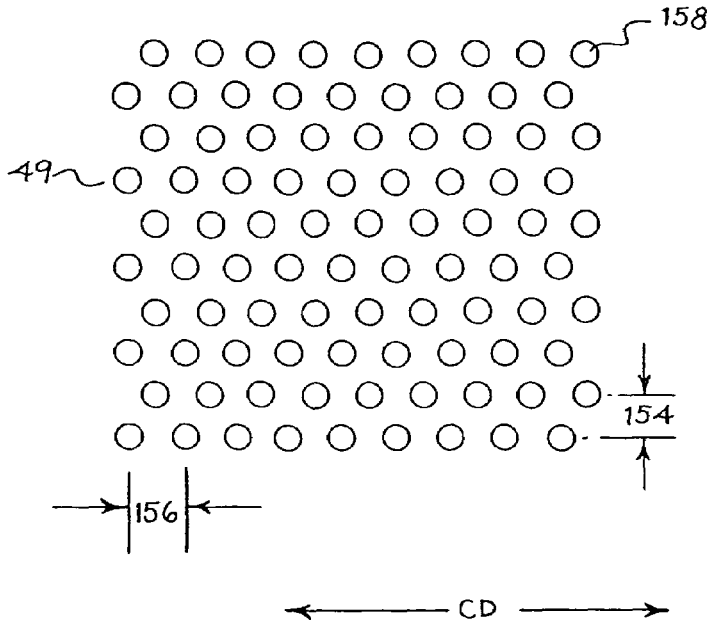
FIG. 14 is a plan view of the surface of a transfer shoe.

Referring to FIG. 14, the curved surface 49 of the transfer shoe may further have a plurality of dimples 158. These dimples may help to channel any excess moisture from the surface of the wet web, or they may help to provide sufficient friction to assist in the formation of the cigarette. The dimples may be cylindrical elements having a diameter of about 1.5 mm and a height of about 1 mm. The tops of the dimples may be rounded, they may be flat, or they may have ridges which can have a height of about 0.05 mm. These dimples may be arrayed as shown in FIG. 14, with rows along the cross direction which have a spacing 154 of 2.5 mm, and a spacing 156 of the dimples within the row of 3.00 mm. Alternate rows may be offset by 1.50 mm. Such a configuration provides for about 85 dimples per square inch. The dimpled surface of the transfer shoe may also be covered with a belt.

The web 42, upper winding roller, and transfer shoe converge to trap a portion of the web between the smooth region of the upper winding roller and the ridge on the transfer shoe. A perforated web will have a line of perforation downstream from this line of convergence, and the distance between the line of perforation and the line of convergence may be from 0 mm to the distance between two adjacent lines of perforation. For a web having 5 inches (127 mm) between lines of perforation, the distance between the line of perforation and the line of convergence may be between 0 mm and 127 mm. The distance between the line of perforation and the line of convergence may be from about 1 mm to about 50 mm, from about 5 mm to about 20 mm, and from about 6 mm to about 13 mm.

Referring to FIG. 13, the convergence of the web, upper winding roller, and transfer shoe serves to reduce the speed of the web at that point, relative to the speed of the web at the perforation. The trapped portion of the web is pinched between the upper winding roller and the transfer shoe ridge, and the web is pulled across the smooth insert. The downstream portion of the web 106 remains anchored to the tungsten carbide surface of the upper winding roller just in front of the smooth insert. The action of pulling the web back or stalling the web on the smooth insert breaks the perforation, forming a leading edge 92 connected to the trapped portion of the web. The ridge on the transfer shoe stays engaged to the upper winding roller, pinning the leading edge until the web contacts the edge of the high surface roughness region. The web is then bunched up between the ridge and the high surface roughness region. This bunched portion then doubles back against the upstream portion of the web 105 and begins to roll into a cigarette 86 due to the differential friction between the rough region and the smooth region. The difference between the surface roughness of the rough region and the surface of the transfer shoe is preferably between 700 Ra and 50 Ra.

The cigarette 86 stays in contact with the upper winding roller, and the rotational movement of the upper winding roller continues to roll the cigarette across the surface of the transfer shoe. The upper winding roller may also move slightly upward (vertically) to allow the cigarette to increase in diameter. The cigarette then moves off the transfer shoe surface and into the gap 152 between the upper winding roller and lower winding roller. Simultaneously, the speed of the lower winding roller is increased from a speed less than the speed of the web to substantially the same speed as the web. The transfer shoe may have fingers that mesh with grooves in the lower winding roller to provide a smooth surface for the cigarette to transition from the shoe to the roller. The growing roll continues to move into the winding pocket 60 until contacted by the rider roller. During the winding of the roll, the lower winding roller and the rider roller rotate at speeds substantially the same as the upper winding roller. The log continues to wind, increasing in size until the proper sheet count and/or diameter is obtained. The rotational speeds of the upper winding roller, the lower winding roller, and the rider roller may be independently varied to control the winding firmness.

It is preferred that the lower winding roller has a tungsten carbide surface. Preferably, the surface of the upper winding roller has a roughness of at least about 300 Ra, more preferably at least about 500 Ra, more preferably still at least about 600 Ra, and more preferably still at least about 700 Ra.

The rider roller is preferably mounted on a movable rider roller arm 94 (FIG. 2). The rider roller arm allows for release of a wound roll 66 from the roll pocket 60 when the rider roller is moved away from the winding rollers. Convergence of the rider roller with the winding rollers forms the roll winding pocket. As a roll nears completion, the rotational motion of the lower winding roller may decrease, and the rotational motion of the rider roller may increase. This speed differential helps to remove the full size roll from the winding pocket. The motion of the rider roller arm may be coordinated with the movement of the transfer shoe such that the release of a wound roll 66 coincides with the separation of the roll 66 from the web 42 and the start of a cigarette 86. Thus, as the full size roll exits the pocket, the web is sandwiched between the transfer shoe ridge and the smooth region of the upper winding roller.

The rotational motion 70 of the wound roll causes the roll to move out of the pocket in the direction of arrow 68 for subsequent delivery or collection. This motion can be assisted by the difference in relative speeds of the upper and lower winding rollers such that the force of the upper roller dominates. The lower winding roller is optionally equipped with a cover or shroud 64 for a portion of the roller which is not part of the roll winding pocket such that the wound roll may rotate onto a stationary surface.

Referring to FIG. 11, the wound roll may be delivered from the roll winding pocket or from the shroud over the lower winding roller to a log discharge deck 65. This deck is a substantially flat surface positioned at an angle to allow the roll 66 to roll away from the wet winding apparatus 41. The deck may be planar or curved. Motion of a wound roll is preferably one of rotation 70 such that, at the point of contact between the tail 96 of the roll and a surface, the motion of the tail is opposite the overall motion of the roll itself. This inhibits any unwinding of the roll. The discharge deck may optionally be equipped with a movable dispenser gate 78. This gate can control the delivery of wound rolls to a collection point or to subsequent processing apparatus. The motion of the dispenser gate may be coordinated with the motion of the rider roller arm 94 and/or the transfer shoe 48 such that accumulation of wound rolls 66 at the gate is minimized or eliminated.

It is preferred that the materials used for the wetting and winding apparatus, as well as any equipment which is in contact with the wetting solution, are resistant to corrosion. The apparatus and their components may also be coated with corrosion resistant materials. Examples of corrosion resistant materials include 316L stainless steel, nickel and its alloys, tungsten carbide, and poly(tetrafluoroethylene) (TEFLON, DUPONT). The components of the apparatus may be controlled by standard controlling equipment and software. For example, the apparatus may be controlled and monitored with a standard programmable logic controller (PLC). Individual apparatus may have separately controls, and these controls may be operably linked with the main control for the overall apparatus. For example, the winding apparatus may be controlled and monitored with a PanelMate Human Machine Interface (HMI). The HMI can control the starting, stopping, and other parameters that affect the wetting and winding of the web. The HMI may interface to the PLC (Programmable Logic Controller) that actually controls the machine.

The invention claimed is:

1. A method of making a wet careless roll comprising:

a) providing a wet web of material;

b) breaking the wet web and forming a cigarette from the leading edge of the break;

c) forming a roll of the wet web around the cigarette in a roll forming pocket;

d) separating the wet web roll from the web while repeating step b); and e) discharging the separated wet web roll from the roll forming pocket.

2. The method of claim 1, wherein the roll forming pocket comprises a first roller, a second roller, and a third roller.

3. The method of claim 1, wherein the roll forming pocket comprises a first roller, a second roller, and a third roller; the wet web contacting the first roller, the second roller, and the third roller; the first, second and third rollers rotating in the same circular direction; and the second roller rotating in a circular direction opposite from the direction of movement of the wet web.

4. The method of claim 1, further comprising perforating the web.

5. The method of claim 4, further comprising making the break of step b) along a line of perforation.

6. The method of claim 1, wherein the method is performed in an environment which is substantially free of contaminants.

7. The method of claim 1, wherein the web travels at a speed of at least 60 meters per minute.

8. The method of claim 1, wherein the wet web comprises an add-on of a welling solution of at least about 25%.

9. A method of making wet coreless rolls comprising:

providing a wet web;

breaking the wet web;

winding the wet web into a roll using a roll forming pocket;

the roll forming pocket comprising a first roller, a second roller and a third roller; the wet web contacting the first roller, the second roller, and the third roller; the first, second and third rollers rotating in the same direction; and the second roller rotating in a direction opposite from the direction of movement of the wet web; and discharging the wet web roll from the roll forming pocket.

10. The method of claim 9, wherein the wet web is made by applying a welling solution to a basesheet.

11. The method of claim 10, wherein the wetting solution is applied at an add-on greater than about 25%.

12. The method of claim 10, wherein the welling solution is applied at an add-on between about 25% and about 700%.

13. The method of claim 10, wherein the welling solution is applied at an add-on between about 50% and 400%.

14. The method of claim 10, wherein the wetting solution is applied at an add-on between about 100% and 350%.

15. The method of claim 10, wherein the wetting solution is applied at an add-on between about 150% and 300%.

16. The method of claim 10, wherein the wetting solution is applied at an add-on between about 200% and 250%.

17. The method of claim 10, wherein the wetting solution comprises salt.

18. The method of claim 9, wherein the method is performed in an environment which is substantially free of contaminants.

* * * * *